United States Patent [19]

Newton

[11] 4,060,343

[45] Nov. 29, 1977

[54] CAPACITY CONTROL FOR ROTARY COMPRESSOR

[75] Inventor: Alwin B. Newton, York, Pa.

[73] Assignee: Borg-Warner Corporation, Chicago, Ill.

[21] Appl. No.: 659,188

[22] Filed: Feb. 19, 1976

[51] Int. Cl.[2] ..... F04B 49/02; F01C 21/12; F04C 29/08

[52] U.S. Cl. ..... 417/309; 417/310; 418/78

[58] Field of Search ..... 417/309, 310, 283; 418/30, 75, 78

[56] References Cited

U.S. PATENT DOCUMENTS

| | | | |
|---|---|---|---|
| 2,683,418 | 7/1954 | Smith | 417/309 |
| 3,120,814 | 2/1964 | Mueller | 417/310 |
| 3,286,635 | 11/1966 | Roeske | 417/289 |
| 3,799,707 | 3/1974 | Newton | 418/77 |

*Primary Examiner*—John J. Vrablik
*Attorney, Agent, or Firm*—William S. McCurry

[57] ABSTRACT

A rotary fluid compressor of the sliding vane type having a housing containing a closed working chamber and a rotor eccentrically mounted in the chamber. A control member is rotatably mounted in the housing and provided with an elongated arcuate aperture in fluid contact with the working chamber and spanning at least one of the vanes to permit fluid to bypass the vanes and thereby change the compression volume in the chamber.

2 Claims, 2 Drawing Figures

CAPACITY CONTROL FOR ROTARY COMPRESSOR

BACKGROUND OF THE INVENTION

This invention relates to gas compressors and more particularly to a capacity control system for a rotary gas compressor.

Rotary gas compressors of the vane type comprise an eccentric rotor containing a plurality of radially extending blades engaging a cylindrical housing. The eccentric rotor is in substantial contact with the cylindrical housing over a minor portion of the housing and is spaced from the housing over a substantial portion of the housing periphery to form a crescent-shaped working chamber. The chamber is provided with one or more suction or inlet ports on one side of the contact area and one or more discharge or outlet ports on the other side of said contact area. As the rotor is rotated within the housing, the radially extending blades contact the housing periphery and compress the gas entering the suction or inlet port throughout the crescent-shaped working chamber and the compressed gas is discharged through the discharge or outlet port.

It is sometimes desirable to control the capacity of such a rotary gas compressor. One such control is shown in U.S. Pat. No. 3,799,707 wherein a rotatable control plate containing an elongated arcuate aperture is positioned against the end of the bladed rotor and a plurality of slots are provided in the periphery of the rotor so that when the control plate is rotated the elongated arcuate aperture can be placed in communication with the rotor slots to thereby vent the compression side of the working chamber to the suction or inlet side of the chamber to control the capacity of the compressor.

SUMMARY OF THE INVENTION

The present invention also utilizes a rotary control plate and an elongated arcuate aperture to control the capacity of a bladed rotor gas compressor. However, both the construction of the control plate and its control are different than and an improvement upon the capacity control of the aforementioned patent.

The present capacity control system utilizes a rotary control plate containing an elongated arcuate aperture which directly communicates the front side of one or more blades with the trailing side of one or more blades to vent the discharge or outlet side of the compression chamber to the suction or inlet side to control the capacity of the compressor. Further, a new and improved means is provided to rotate the control plate and comprises hydraulic means under control of the suction pressure of the compressor to rotate the control plate.

The advantages of the present invention over the prior art structures will be evident by reference to the following description taken in conjunction with the accompanying drawings.

DETAILED DESCRIPTION OF THE INVENTION

Figure 1:
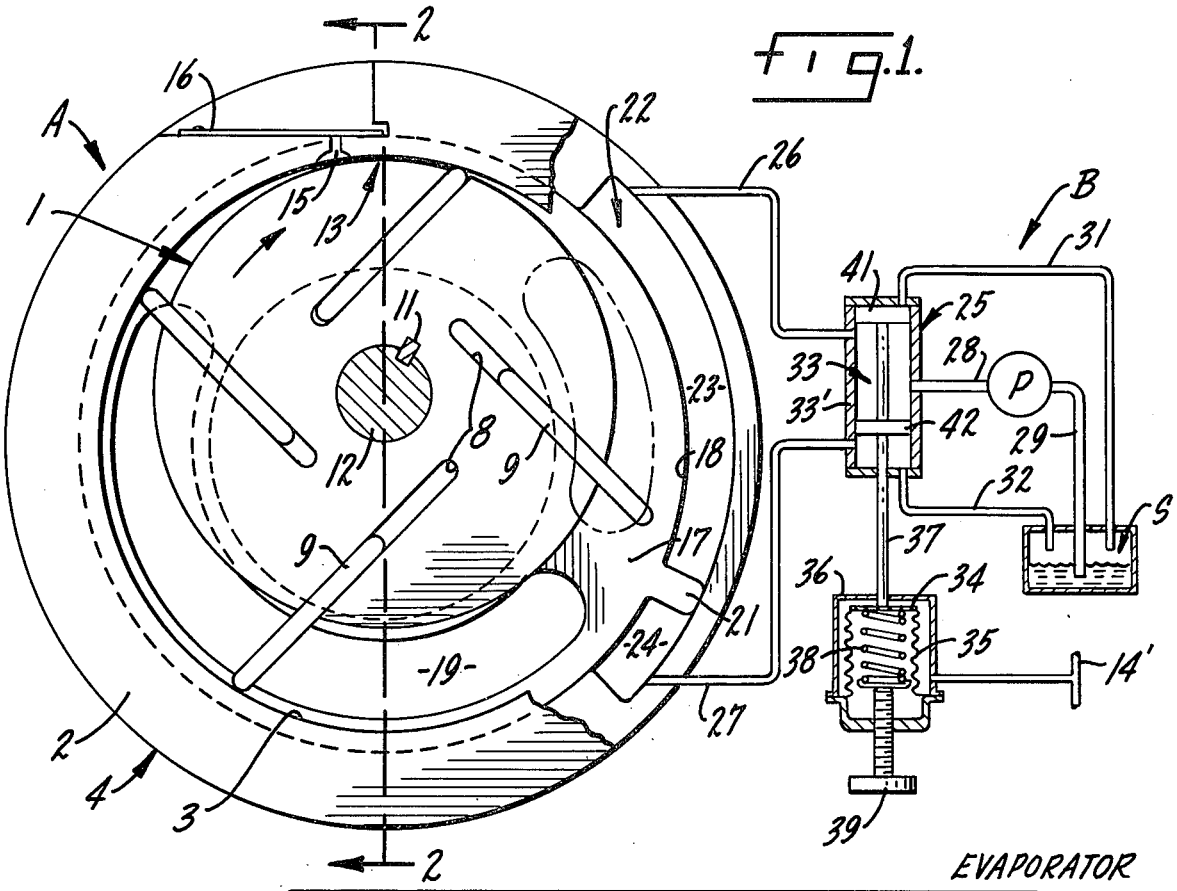
FIG. 1 is an end view, partially in section and partially broken away and also including a schematic depiction of the control system of a rotary gas compressor constructed in accordance with the present invention.
Figure 2:
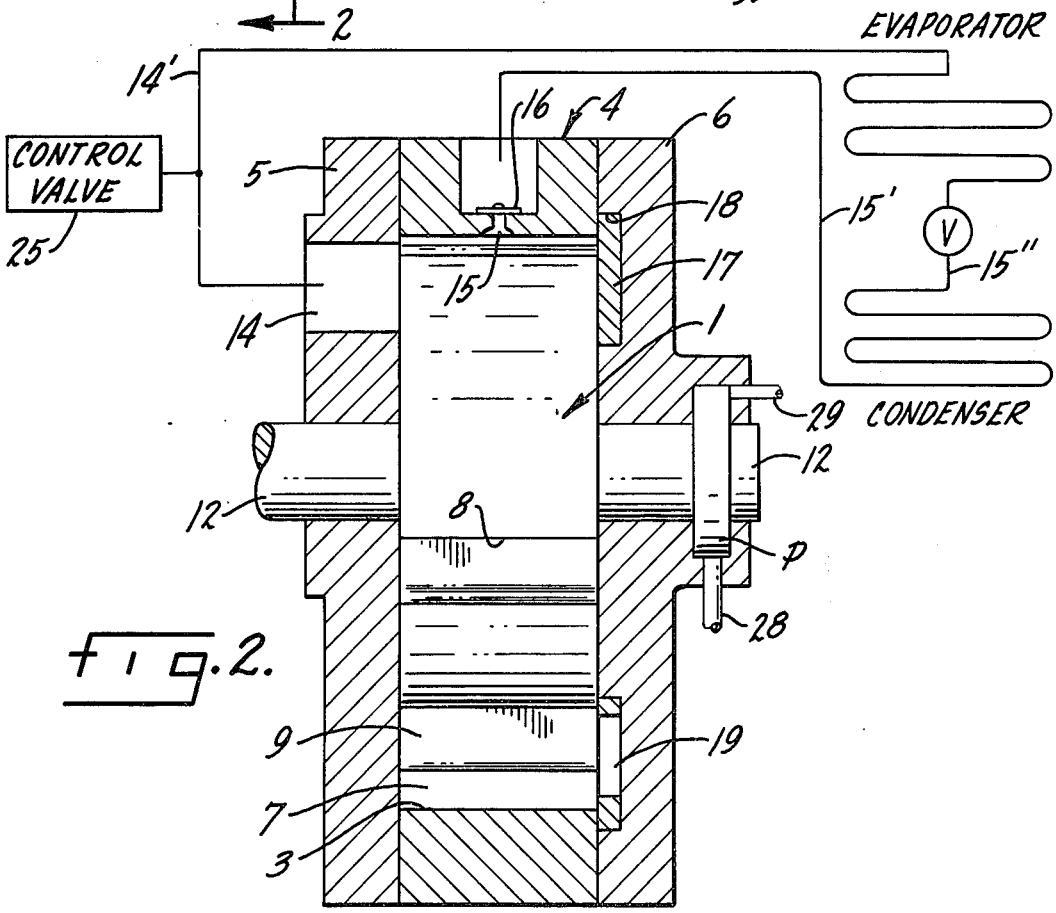
FIG. 2 is a cross-sectional view of the compressor taken along the lines 2—2 of FIG. 1.

Referring to FIGS. 1 and 2, the gas compressor A is controlled by capacity control B. The compressor A comprises a rotor 1 rotatable within a stator 2. The stator 2 comprises a cylinder 3 formed within a housing 4. The housing 4 has end plates 5 and 6 enclosing the rotor 1 and stator 2 and defining the working chamber 7.

The rotor 1 is eccentrically mounted in the housing 4 and contains a plurality of equidistantly spaced slots 8 adapted to receive blades or vanes 9 which slide and reciprocate in the slots in a conventional manner. The rotor 1 is keyed at 11 to a drive shaft 12. The rotor 1 is in a substantially sliding contact with the housing 4 at area 13 providing the generally crescent-shaped working chamber 7.

A suction or inlet port 14 is provided in the end plate 5 and communicates the exhaust of an evaporator E by way of line 14' with the working chamber 7 on one side of the contact area 13. One or more discharge or outlet ports 15 are provided in the housing 4 and in communication with the chamber 7 on the other side of said contact area 13. Discharge ports 15 are connected to a condenser C by means of a line 15'. One or more reed valves 16 are utilized to cover the ports 15 to prevent the reverse flow of gas into the chamber 7 from the line 15'. The condenser C is connected to the evaporator E by a line 15" which line contains an expansion valve V.

Means for changing the effectiveness of the blades 9 in the working chamber 7 to thereby control the capacity of the rotary compressor A comprises a control plate 17 rotatably mounted in a groove or recess 18 of the end plate 6. The control plate has formed therein an elongated arcuate aperture 19 in contact with the chamber 7. The plate 17 has a protuberance or extension 21 fitting snugly within a recess or groove 22 in the housing 4. The purpose of the arcuate aperture 19, as will be more fully explained hereafter, is to shorten or lengthen the discharge area of the chamber 7 to control the capacity of the compressor by permitting gas to bypass the blades 9 and thereby vent the compression side of the chamber 7. A conventional oil pump P, such as a Gerotor pump, is mounted in the end plate 6 and the stator of the pump is driven by the drive shaft 12.

The protuberance or extension 21 of the plate 17 divides the recess or groove 22 into chambers 23 and 24 which receive hydraulic fluid from the capacity control B. The control B comprises a control valve 25 connected by hydraulic lines 26 and 27 to the chambers 23 and 24 respectively of the recess or groove 22, and also connected to the hydraulic pump P by means of line 28. A line 29 connects the pump P to an oil source or sump S. Also connected to the sump S are exhaust lines 31 and 32.

The control valve 25 comprises a hydraulic valve 33 within a housing 33' for controlling the flow of fluid to the lines 26 and 27 and adapted to be actuated by suction pressure from the inlet side of the working chamber 7. A diaphragm 34 sealably connected to a bellows 35 is provided within a housing 36. The diaphragm 34 is adapted to actuate a valve rod 37 and valve 33. The diaphragm 34 is biased in one direction by a spring 38 and biased in the other direction by compressor suction pressure. A screw 39 is used for adjusting the tension on spring 38. Lands 41 and 42 are provided on the rod 37 to alternately direct hydraulic fluid to and from the lines 26 and 27.

OPERATION

As shown in FIG. 1, the rotor 1 is being driven by the drive shaft 12 in the direction of the arrows; the plate 17 is in its clockwise position; the control valve 25 is in a position exhausting the housing 33' by means of exhaust line 31 to sump S, because the suction pressure in the housing 36 is insufficient to overcome the bias of spring 38; and the land 41 is in a position to permit hydraulic fluid from the pump P by way of line 28 to enter line 26, fill the chamber 23 to move the protuberance or extension 21 to its shown position; and the oil from the chamber 24 is exhausted through the hydraulic line 27, the valve housing 33' and the exhaust line 32 to sump S. Under these conditions, the elongated arcuate aperture 19 is in substantially its clockwise position thereby providing only a relatively small working or compression area adjacent the discharge or outlet port 15 and consequently a relative decrease in the capacity of the compressor. As the suction pressure increases, the pressure on the diaphragm 34 becomes sufficient to overcome the bias of the spring 38 and move the valve rod 37 and land 42 to a position to permit the chamber 23 to exhaust through the housing 33' and line 31 to sump S while hydraulic fluid from the pump P enters line 27 and chamber 24 to move the protuberance 21 to substantially its counterclockwise position. In this position, the aperture 19 is also in its counterclockwise position whereby the effective or compression area of the working chamber 7 is increased at the discharge or compression area of the chamber 7, and the capacity of the compressor is thereby increased.

While the above embodiment itilizes suction pressure to actuate the control plate 17, it is to be understood that other sensing means can be employed to operate the plate without departing from the broadest scope of the present invention.

I claim:

1. A rotary fluid compressor comprising a housing having a closed working chamber provided with a substantially cylindrical surface, said housing having an inlet port and an outlet port communicating with said chamber; a rotor mounted in said chamber and rotatable about an axis eccentric to the axis of said cylindrical surface, said rotor having contact with said cylindrical surface at one point on its periphery, and a plurality of vanes slidably supported in said rotor and engaging said cylindrical surface whereby when said rotor is rotated said vanes compress fluid from said inlet port to said outlet port providing a compression area within said chamber; and a control member rotatably mounted in said housing and provided with an elongated arcuate aperture in fluid contact with said working chamber and spanning at least one of said vanes to permit fluid to bypass the vanes and thereby change the compression area in said chamber, said control member being operative upon rotation thereof to vary the location of the aperture to vary the compression volume of said chamber to thereby vary the capacity of the compressor, and means to rotate said control member, said means comprising a hydraulic valve operatively connected to said control member and actuated by a diaphragm which is responsive to the suction pressure of the compressor.

2. A rotary fluid compressor in accordance with claim 1 wherein said hydraulic valve comprises a control member having a protuberance thereon and being received in a recess in said housing and dividing said recess into two chambers, said chambers and said protuberance being in contact with fluid pressure.

* * * * *